US008074380B2

(12) United States Patent
Narajowski et al.

(10) Patent No.: US 8,074,380 B2
(45) Date of Patent: Dec. 13, 2011

(54) MODULAR BOOT SOLE SYSTEM

(75) Inventors: David Narajowski, Park City, UT (US); Jacob Hall, Draper, UT (US); Chad Whittaker, Sacramento, CA (US); David Mellon, Park City, UT (US); Derek Gustafson, Salt Lake City, UT (US); Jeremy Saxton, Draper, UT (US); Mark Vincent Santurbane, San Luis Obispo, CA (US); Thomas Laakso, Park City, UT (US)

(73) Assignee: Black Diamond Equipment, Ltd., Salt Lake City ( * ) Notice: Subject to any disclaimer, the term of this patent is extended or adjusted under 35 U.S.C. 154(b) by 612 days.

(21) Appl. No.: 12/263,479

(22) Filed: Nov. 2, 2008

(65) Prior Publication Data

US 2009/0113763 A1 May 7, 2009

Related U.S. Application Data

(60) Provisional application No. 60/985,653, filed on Nov. 6, 2007.

(51) Int. Cl.
*A43B 5/04* (2006.01)

(52) U.S. Cl. ..... 36/117.3; 36/15

(58) Field of Classification Search ..... 36/15, 100, 36/117.1, 117.3
See application file for complete search history.

(56) References Cited

U.S. PATENT DOCUMENTS

| | | | | |
|---|---|---|---|---|
| 3,526,976 | A * | 9/1970 | Jacobs | 36/100 |
| 4,499,674 | A * | 2/1985 | Olivieri | 36/117.3 |
| 4,936,028 | A * | 6/1990 | Posacki | 36/15 |
| 4,937,955 | A * | 7/1990 | Bonaventure | 36/132 |
| 5,214,865 | A * | 6/1993 | Sartor | 36/117.3 |
| 5,293,702 | A * | 3/1994 | Miyoshi et al. | 36/117.5 |
| 5,918,386 | A * | 7/1999 | Marmonier | 36/117.3 |
| 6,065,228 | A | 5/2000 | Begey et al. | |
| 6,609,313 | B2 * | 8/2003 | Orso | 36/117.3 |
| 7,254,905 | B2 * | 8/2007 | Dennison | 36/15 |
| 2002/0088146 | A1 * | 7/2002 | Joseph et al. | 36/117.3 |
| 2009/0113763 | A1 * | 5/2009 | Narajowski et al. | 36/117.3 |
| 2009/0255149 | A1 * | 10/2009 | Rigat | 36/117.3 |
| 2010/0115798 | A1 * | 5/2010 | Sartor et al. | 36/117.3 |

* cited by examiner

*Primary Examiner* — Marie Patterson
(74) *Attorney, Agent, or Firm* — Baker & Associates PLLC; Trent H. Baker

(57) ABSTRACT

One embodiment of the present invention relates to a ski boot system with a modular binding interface. The system includes a shell encasing a user's foot and lower leg. A first and second block are interchangeably coupled to the shell below the base to effectuate alternative binding interfaces. The first and second blocks include a binding interface surface and a sole surface. The positioning and shape of the blocks with respect to the shell results in the binding interface surface extending distally from the toe region of the shell and the sole surface being the lowest surface on the boot system. The binding interface surfaces for each block are positioned at different sagittal heights with respect to the shell to facilitate the interconnection with alternative binding coupling systems. The sole surfaces for each block are positioned at substantially identical sagittal heights with respect to the shell to maintain optimum and consistent performance characteristics among different bindings.

20 Claims, 6 Drawing Sheets

MODULAR BOOT SOLE SYSTEM

RELATED APPLICATIONS

This application claims priority to U.S. provisional application Ser. No. 60/985,653 filed Nov. 6, 2007, the contents of which are incorporated by reference.

FIELD OF THE INVENTION

The present invention generally relates to a modular boot binding interface system. In particular, the invention relates to a ski boot system with a modular boot binding interface.

BACKGROUND OF THE INVENTION

A boot is a type of footwear that encases both the foot and a portion of the lower leg of a user. Boots are generally manufactured for a particular purpose or activity and therefore are designed to include characteristics consistent with the intended purpose. For example, a hiking boot is designed to support the ankle of a user while minimizing the overall weight. Likewise, a ski boot is designed to maximize a user's performance at a particular skiing activity.

Boots generally include a shell, a compression system, and a sole. The shell and compression system operate to encase and support the foot and lower leg of a user. Various well-known shell and compression systems are utilized to allow users to insert and remove their feet in an open boot configuration and compress the shell around the foot in a closed boot configuration. The sole of a boot is disposed on the bottom surface of the shell. The sole is generally composed of a rubber or plastic material. The sole may consist of a single piece or multiple blocks. The stiffness and/or weight characteristics of the sole have an affect on the overall performance of the boot.

The general activity of skiing comprises many subsets including but not limited to alpine touring, telemark, and downhill. Each subset of skiing generally corresponds to a unique system of specialized equipment. For example, the boot, ski, and binding systems used for telemark skiing are significantly different from those used for alpine touring. A skiing system may include standard types of boots, skis, and bindings. Each type of skiing also requires unique characteristics of a boot to achieve optimal performance. In addition, particular terrain and skier preference may require an even more specific set of performance characteristics. Boots for particular skiing activities must be compatible with the remainder of the system. For example, telemark skiing boots have generally been required to conform to the 75 mm standard to allow for compatibility with telemark type bindings.

One of the problems with existing boot systems is their limited adaptability to a variety of systems, activities and/or user preferences. Most conventional skiing boots can be adjusted with the compression system to provide different degrees of compression between the shell and user's foot. This adjustment can be used to control a variety of characteristics. However, certain boot performance characteristics such as binding compatibility, sole flex, torsion, and weight cannot be adjusted with the compression system.

Therefore, there is a need in the industry for a modular boot system that allows for multi-binding compatibility and the adjustment of certain sole related flexibility and weight characteristics without substantially affecting performance.

SUMMARY OF THE INVENTION

The present invention generally relates to a modular boot binding interface system. One embodiment of the present invention relates to a ski boot system with a modular binding interface. The system includes a shell encasing a user's foot and lower leg. A first and second block are interchangeably coupled to the shell below the base to effectuate alternative binding interfaces. The first and second blocks include a binding interface surface and a sole surface. The positioning and shape of the blocks with respect to the shell results in the binding interface surface extending distally from the toe region of the shell and the sole surface being the lowest surface on the boot system. The binding interface surfaces for each block are positioned at different sagittal heights with respect to the shell to facilitate the interconnection with alternative binding coupling systems. The sole surfaces for each block are positioned at substantially identical sagittal heights with respect to the shell to maintain optimum and consistent performance characteristics among different bindings. A second embodiment of the present invention relates to a ski boot system including a shell, a block, and a modular coupling system. A third embodiment of the present invention relates to a method for modularly coupling alternative blocks to a shell on a ski boot so as to effectuate alternative binding interface surface sagittal positions without substantially effecting sagittal sole surface orientation.

Embodiments of the present invention represent a significant advance in ski boot and boot binding interface technology. Conventional boots generally include a single connection interface such as a duckbill toe platform for coupling with a binding. The single connection interface may only facilitate connection with compatible bindings. Conventional boot systems may also include a system for modularity that enables interchangeable blocks to be positioned on the bottom of the boot. However, these conventional modular systems affect the performance of the boot binding system by effecting the sagittal height and/or angle between the boot and the binding. Embodiments of the present invention overcome these limitations by providing a modular system that enables boot binding compatibility between a wide range of connection schemes by enabling a custom binding interface surface position. In addition, the system ensures that the spacing and orientation of the boot with respect to the binding will remain consistent by maintaining a constant sole surface position.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. The Figures presented in conjunction with this description are views of only particular—rather than complete—portions of the systems and methods of making and using the system according to the invention. In the Figures, the physical dimensions may be exaggerated for clarity.

DETAILED DESCRIPTION OF THE INVENTION

Figure 1:
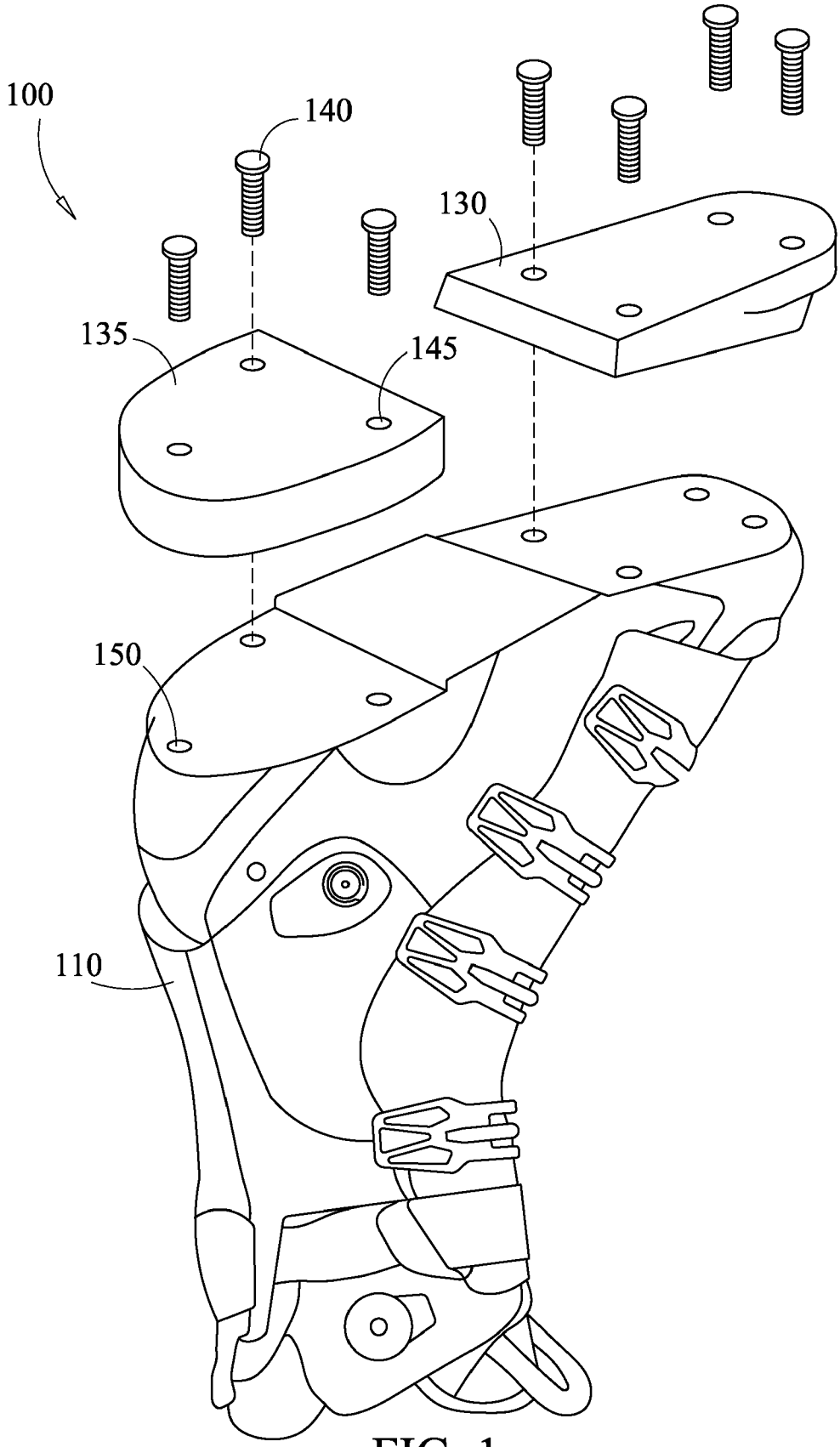
FIG. 1 illustrates an inverted exploded perspective view of a boot system in accordance with a first general embodiment of the present invention, including a ski boot shell with two boot blocks coupled via a modular coupling system.

The present invention generally relates to a modular boot binding interface system. One embodiment of the present invention relates to a ski boot system with a modular binding interface. The system includes a shell encasing a user's foot and lower leg. A first and second block are interchangeably coupled to the shell below the base to effectuate alternative binding interfaces. The first and second blocks include a binding interface surface and a sole surface. The positioning and shape of the blocks with respect to the shell results in the binding interface surface extending distally from the toe region of the shell and the sole surface being the lowest surface on the boot system. The binding interface surfaces for each block are positioned at different sagittal heights with respect to the shell to facilitate the interconnection with alternative binding coupling systems. The sole surfaces for each block are positioned at substantially identical sagittal heights with respect to the shell to maintain optimum and consistent performance characteristics among different bindings. A second embodiment of the present invention relates to a ski boot system including a shell, a block, and a modular coupling system. A third embodiment of the present invention relates to a method for modularly coupling alternative blocks to a shell on a ski boot so as to effectuate alternative binding interface surface sagittal positions without substantially effecting sagittal sole surface orientation. Also, while embodiments of the present invention are directed at alpine touring and telemark ski boots, it should be known that the teachings of the present invention are applicable to other fields including but not limited to other types of boots.

The following terms are defined as follows:

Ski—Any type of skiing apparatus that allows a user to translate on a snow surface, including but not limited to cross country skis, alpine skis, powder skis, telemark skis, downhill skis, snowboards, splitboards, skiboards, etc.

Sole—Any component(s) attached to the bottom of the shell of a boot including but not limited to a toe block, heel block, single sole piece, rigid members, attachment members, grip members, rubber pieces, etc.

Toe block—One or more pieces of material attached on the bottom surface of a boot corresponding with the plantar surface of a user's foot, wherein the one or more pieces are disposed in a frontal region of the sole corresponding to the metatarsal and phalange bones of a user's foot.

Heel block—One or more pieces of material attached on the bottom surface of a boot corresponding with the plantar surface of a user's foot, wherein the one or more pieces are disposed in a rear region of the sole corresponding in whole or part to the heel region of a user's foot.

Binding interface surface—a boot system surface extending distally or proximally from the boot shell and upon which a binding may couple. For example a duckbill includes a binding interface surface extending distally from the toe region of the ski boot to enable the releasable coupling of a Telemark type binding.

Sole surface—a boot system surface oriented as the lowest sagittal surface. For example, the surface of the boot system which is in direct contact with a binding. The sole surface may be composed of materials including but not limited to rubber and may include a tread pattern.

Sagittal plane—An anatomical plane oriented vertically so as to bisect the left and right portions of the body. The sagittal plane is used herein for orientation purposes with respect to a boot as it is related to a human foot and lower leg. A boot which is placed on a human foot is effectively oriented sagittally (parallel to the sagittal plane) in a profile perspective. Therefore, the bottom of the boot is sagittally below the top of the boot. The term "sagittally" may also refer to a position within the sagittal plane such as an elevation.

Transverse plane—An anatomical plane oriented horizontally so as to bisect the top and bottom portions of the body. The transverse plane is used herein for orientation purposes with respect to a boot as it is related to a human foot and lower leg. A boot which is placed on a human foot is oriented orthogonally to the transverse plane. Therefore, a transversely oriented member on the boot would extended horizontally or between the sides of the boot. For example, the bottom surface of the boot may three dimensionally extend transversely.

Reference is initially made to FIG. 1, which illustrates an inverted exploded perspective view of a boot system, designated generally at 100. The illustrated system 100 enables alternative blocks to be coupled to the shell to facilitate increased compatibility with binding systems. The system includes a shell 110 and two boot bocks 130, 135. The boot blocks 130, 135 are coupled to the shell via a modular coupling system including a plurality of couplers 140 extending through recesses 145, 150 in both the blocks 130, 135 and the shell 110 respectively. The couplers 140 may be any type of elongated coupling devices such as bolts, screws, pins, etc. Likewise, the recesses 145, 150 may include various recess types including but not limited to threaded recesses, bosses, etc. The boot blocks 130, 135 may further contain various surfaces to facilitate the interconnection with bindings. The modular coupling system is configured and oriented to maintain performance characteristics with alternative boot blocks. Various alternative modular coupling systems will be described and illustrated throughout the application in accordance with alternative embodiments of the present invention. Likewise, various alternative boot blocks will be illustrated and described to facilitate connection with binding systems. It will be appreciated that the illustrated boot system is applicable to all ski related boots and binding systems, including but not limited to alpine touring, alpine, telemark, cross-country, snowboard, etc.

Figure 2A:
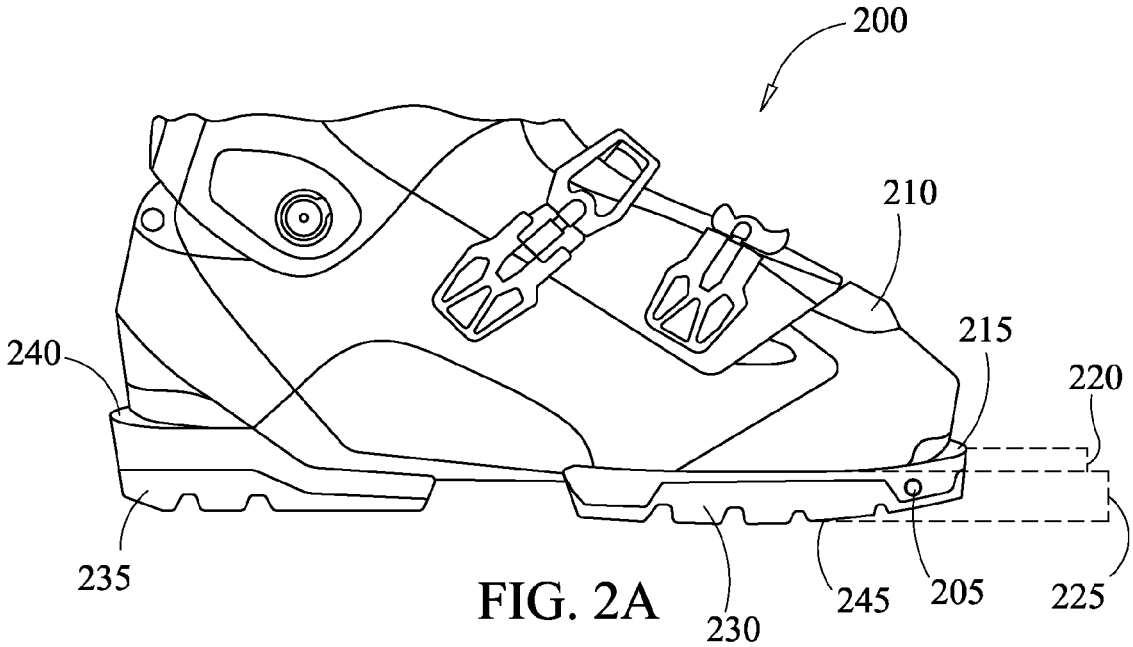
FIGS. 2A and 2B illustrate profile views of a boot system with alternative blocks respectively in accordance with embodiments of the present invention, further illustrating the positioning and relative spacing of the binding interface surface and the sole surface between the alternative blocks.
Figure 2B:
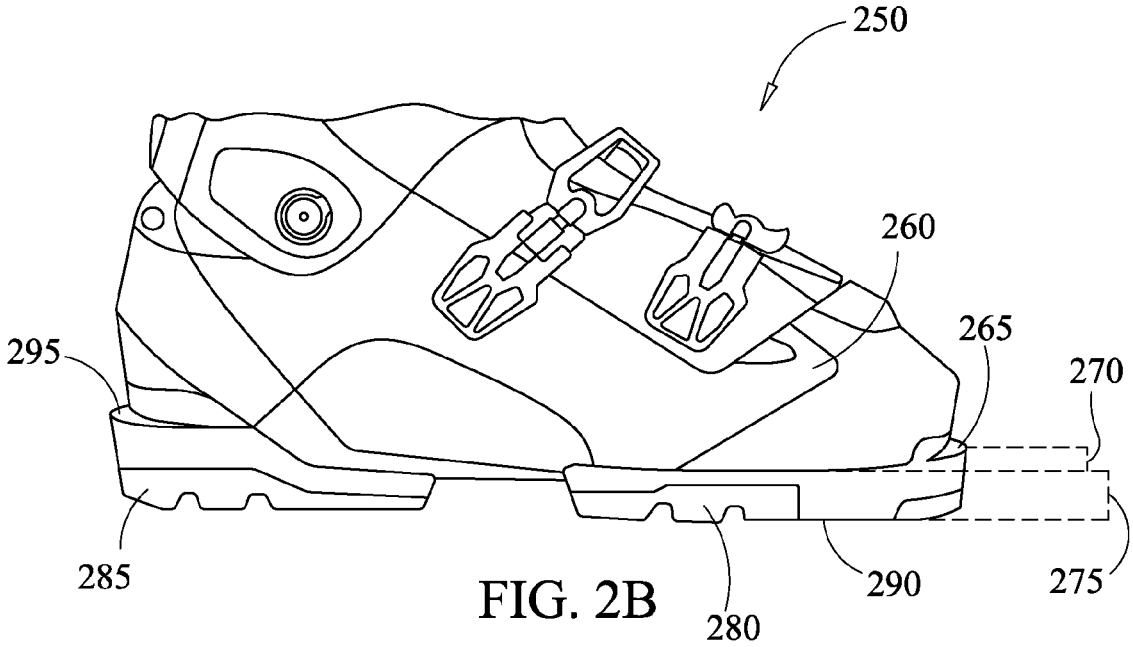

Reference is next made to FIGS. 2A and 2B, which illustrate profile views of a boot system with alternative blocks respectively, designated generally at 200 and 250 respectively. FIGS. 2A and 2B illustrate alternative boot blocks and the critical effect of the modular coupling system, which ensures that boot-binding performance is maintained across the alternative blocks. FIG. 2A illustrates a boot system 200 comprising a shell 210, a front block 230, and a rear block 235. The front and rear blocks 230, 235 are releasably coupled to the shell 210 via a modular coupling system (not shown). The front block 230 further includes a binding interface surface 215, a sole surface 245, and a binding interconnect 205. The binding interface surface 215 extends distally from the shell 210 and provides a surface upon which a portion of a binding system may couple (not shown). The sole surface 245 is disposed sagittally below the shell 210 and forms the lowest sagittal surface of the boot system 200. The spacing between the bottom of the shell 210 and the binding interface surface 215 may be referred to as the shell-binding interface surface distance 220. The spacing between the bottom of the shell 210 and the sole surface 245 may be referred to as the shell-sole surface distance 225. The binding interconnect 205 provides a transverse connection point at which a binding may couple with the boot system 200. The binding interconnect 205 may provide a coupling for an alpine touring binding system (i.e. Dynafit-type binding). The rear block 235 includes a secondary binding interface surface 240 which may be used in conjunction with the binding interface surface 215 and/or the binding interconnect 205 to couple a binding to the boot system 200. Various additional binding interconnects (not shown) may be disposed on the rear block 235 to facilitate interconnection with particular binding systems.

FIG. 2B illustrates a corresponding boot system 250, including the same shell 260 as FIG. 2A, a front block 280, and a rear block 285. The front and rear blocks 280, 285 are releasably coupled to the shell 210 via a modular coupling system (not shown). The front block 280 further includes a binding interface surface 265 and a sole surface 290. The binding interface surface 265 extends distally from the shell 260. The sole surface 290 is disposed sagittally below the shell 260 and forms the lowest sagittal surface of the boot system 250. The spacing between the bottom of the shell 260 and the binding interface surface 265 may be referred to as the shell-binding interface surface distance 270. The spacing between the bottom of the shell 260 and the sole surface 290 may be referred to as the shell-sole surface distance 275. The rear block 285 includes a secondary binding interface surface 295 which may be used in conjunction with the binding interface surface 265 to couple a binding to the boot system 200. It is important to note that the shell-binding interface surface distance 270 illustrated in FIG. 2B is different than the shell-binding interface surface distance 220 illustrated in FIG. 2A. The different front blocks 230, 280 adjust the binding interface surfaces 215, 265 so as to be at a height that accommodates a particular binding. Conventional modular boot bocks maintain the same positioning of the binding interface surface with respect to the shell, but the sole surface adjusts to accommodate alternative binding connection schemes. Since the illustrated front blocks 230, 280 adjust the height of the binding interface surfaces 215, 265, the shell-sole surface spacing 225, 275 is substantially the same. Therefore, the spacing between the lowest surface of the boot system 200, 250 is maintained across alternative boot blocks and bindings. The constant spacing between the boot and binding maintains performance characteristics across alternative blocks and bindings by enabling the boot to be specifically tuned to a single boot-binding spacing.

Figure 3A:
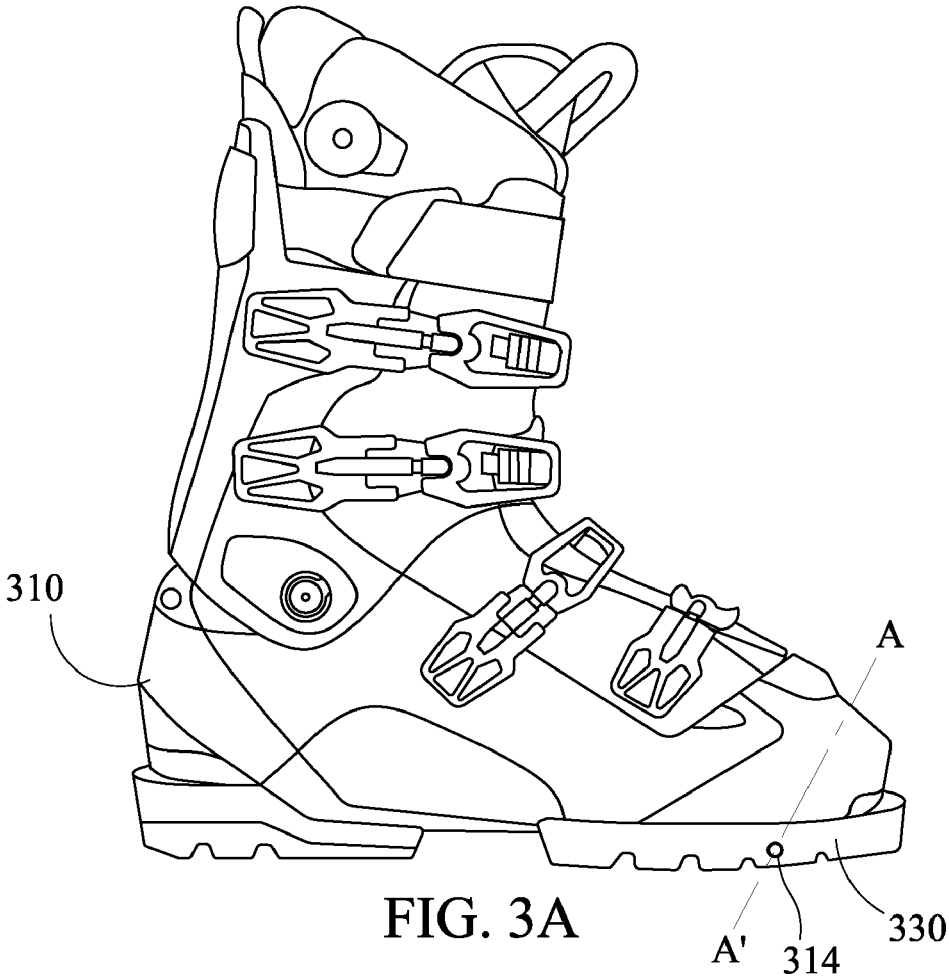
FIG. 3A illustrates a boot system with an alternative modular coupling system in accordance with embodiments of the present invention.
Figure 3B:
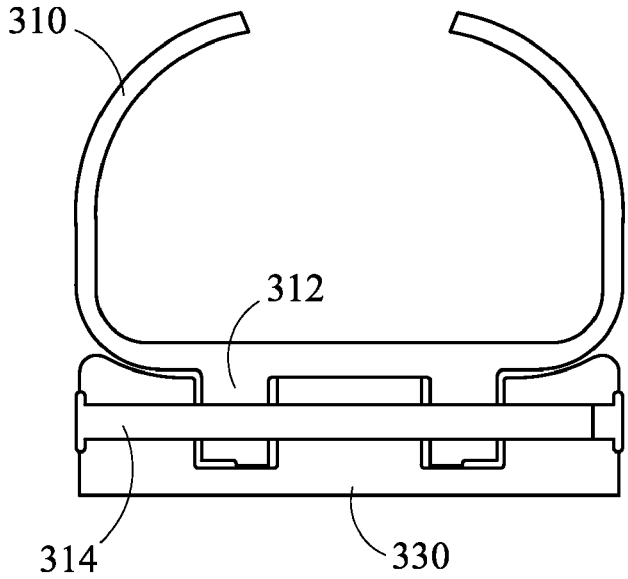
FIG. 3B illustrates a cross section view of the modular coupling system illustrated in FIG. 3A taken along the line A-A'.

Reference is next made to FIGS. 3A and 3B, which illustrates a boot system with an alternative modular coupling system, designated generally at 300. The illustrated boot system 300 includes a shell 210 and a front block 330. The front block 330 is releasably coupled to the shell 310 utilizing the modular coupling system illustrated in FIG. 3B. A cross-sectional orientation line A-A' illustrates the nature of the cross-sectional view shown in FIG. 3B. The modular coupling system includes two extended members 312 extending sagittally downward from the shell 310. The extended members include a transverse recess through which the coupling member 314 is routed. The coupling member 314 is also routed through a transverse recess in the front block 330. Therefore, the transverse routing of the coupling member 314 through the extended members 312 and the front block 330 effectively couples the front block 330 to the shell. It will be appreciated that this particular modular coupling system may be used in conjunction with the other modular coupling systems illustrated throughout this application in accordance with alternative embodiments of the present invention.

Figure 4A:
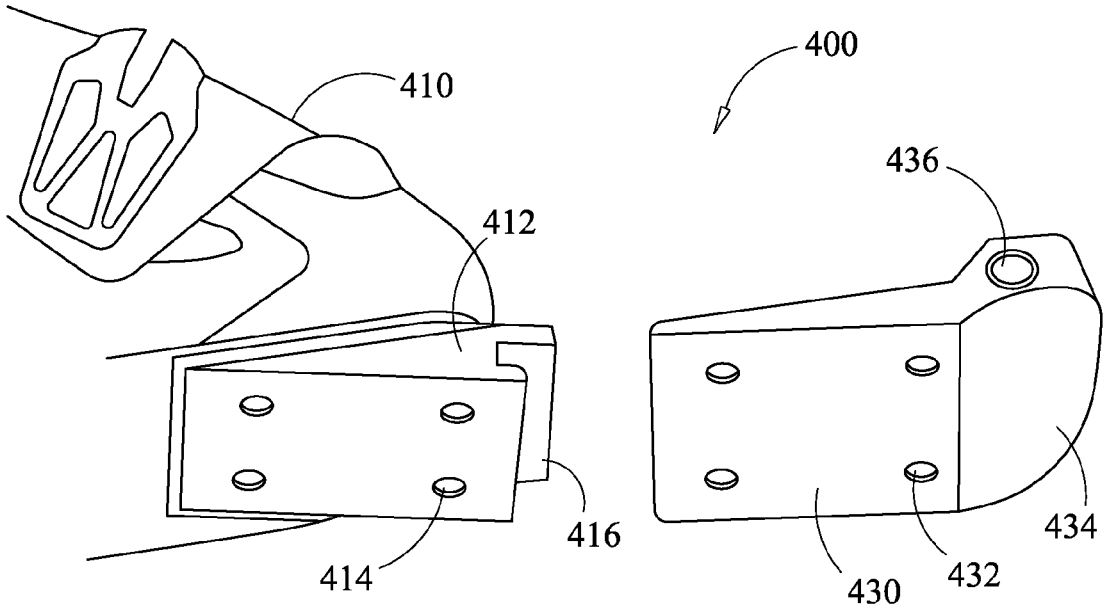
FIGS. 4A-4F illustrate perspective views of alternative modular coupling systems in accordance with embodiments of the present invention.

Reference is next made to FIGS. 4A-4G, which illustrate views of alternative modular coupling systems. The illustrated systems show the primary supportive structures of the boot blocks, but it will be appreciated that additional components may be added including but not limited to rubber outer surfaces. FIG. 4A illustrates a shell 410 with a bracket member receptacle 412 and a bracket member 430. The bracket member receptacle 412 includes a plurality of recesses 414 and a male geometrically keyed region 416. The bracket member 430 further includes a plurality of bracket recesses 430, a female geometrically keyed region 434 (only outside portion visible), and a binding interconnect 436. The female geometrically keyed region 434 is shaped and configured to key with the male geometrically region 416, thereby coupling the bracket member 430 to the bracket member receptacle 412 of the shell 410. In addition, various coupling members (not shown) may be sagittally routed through the recesses 414 and the bracket recesses 430 to further interconnect the bracket member 430 with the shell 410. The binding interconnect 436 includes transverse recesses for coupling with a binding system. Various rigid components may be disposed within the bracket member 430 to effectively support the binding interconnect 436 with respect to the shell 410. The illustrated concept may be used to securely attach a block to a boot shell in a manner that provides the necessary stability for efficient binding attachment. For example, a Dynafit Tourlite binding system requires that a boot include two recesses on either transverse side of the toe portion of a boot. These recesses must be secured to the boot in a manner that minimizes the boots' ability to laterally pivot about these points. The illustrated concepts include multi-directional coupling between the block and the boot. The illustrated blocks are generally coupled to the boot via one or more attachment members which extend sagitally up from the bottom of the boot. In addition, a portion of the blocks key onto or over the boot in a manner that provides an additional three dimensional transverse direction of coupling between the block and the boot. Various other multi-directional blocks and attachment systems may be used in accordance with the present invention.

Figure 4B:
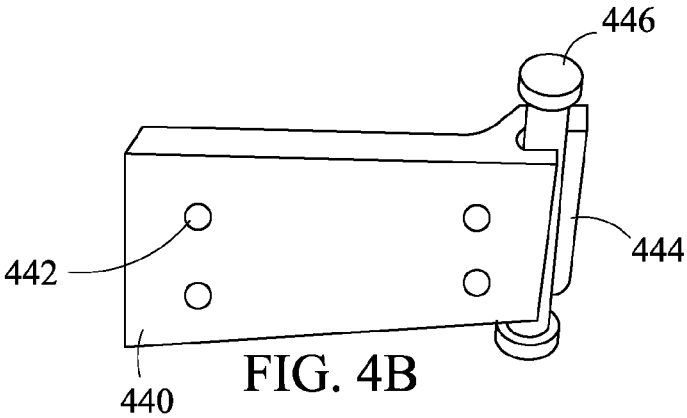
Figure 4C:
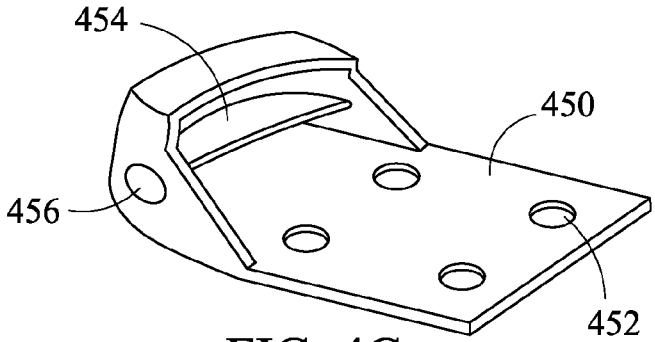
Figure 4D:
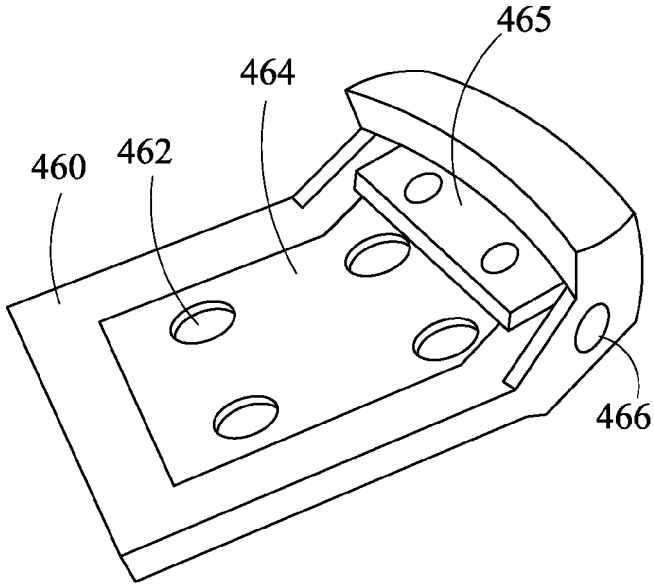
Figure 4E:
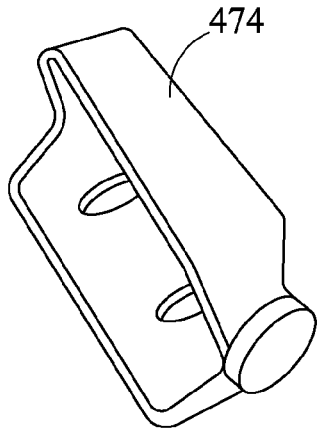
Figure 4F:
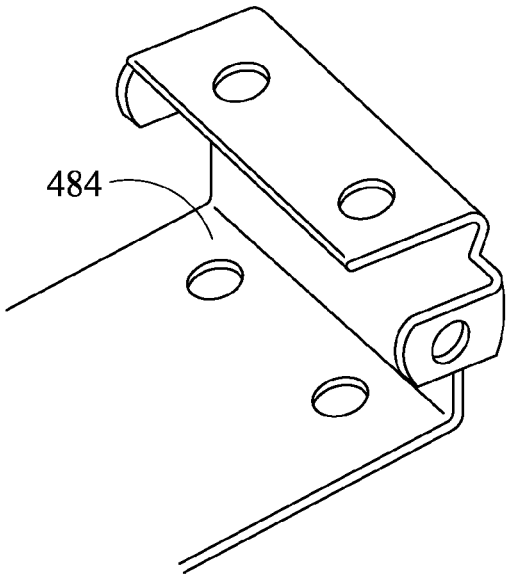
Figure 4G:
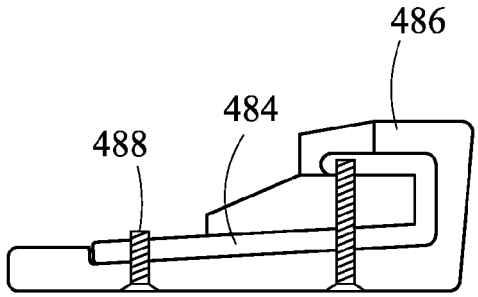
FIG. 4G illustrates a cross sectional perspective view of the alternative modular coupling system illustrated in FIG. 4F.

FIG. 4B illustrates an alternative bracket member 440 including a plurality of bracket recesses 442, a female geometric region 444 (outside of which is shown), and a binding interconnect 446. The illustrated binding interconnect 446 includes a transverse rod-like structure extending across the bracket member 440 to provide the requisite torsional stability. FIG. 4C illustrates a similar alternative bracket member 450 including a plurality of bracket recesses 452, a binding interconnect 456, and a female geometric region 454. The female geometric region is created by a rigid member transversely extending between the binding interconnects 456 disposed on each transverse side of the bracket member 450. FIG. 4D illustrates a similar alternative bracket member 460 including a plurality of bracket recesses 462, a binding interconnect 466, and a rigid metal member 464, and a female geometric region 465. The rigid metal member 464 rigidly forms the bracket recesses 462, part of the female geometric region 465, and the binding interconnect 466. FIG. 4E illustrates a bracket member cap 474 which may encase a bracket member to provide additional stability. FIG. 4F illustrates a rigid metal member 484 which may be utilized as part of a bracket member such as the one illustrated in FIG. 4D. FIG. 4G illustrates a profile view of the rigid metal member 484, including coupling members 488 extending up through bracket recesses and into a shell. FIG. 4G further illustrates an outer boot block region 486 such as a rubber region.

Figure 5A:
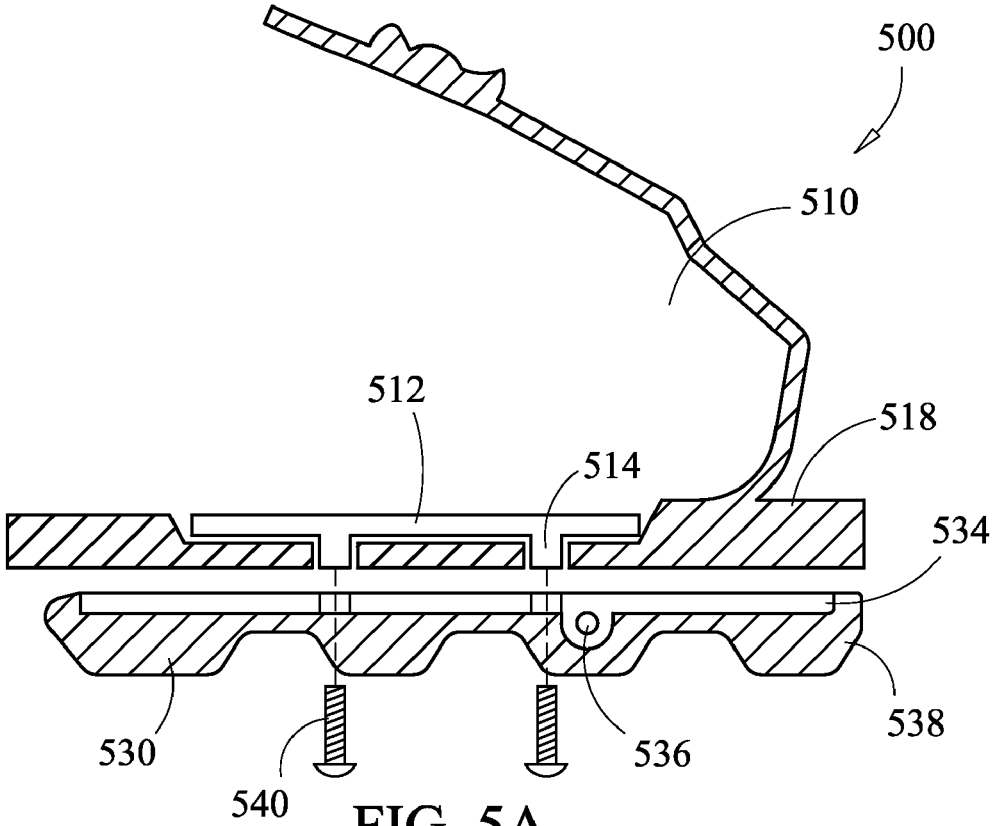
FIG. 5A illustrates a cross sectional profile view of a boot system and modular coupling system in accordance with embodiments of the present invention.
Figure 5B:
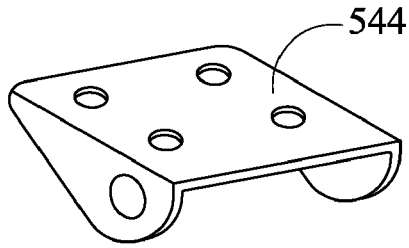
FIGS. 5B-5D illustrate perspective views of components of the modular coupling system illustrated in FIG. 5A.
Figure 5C:
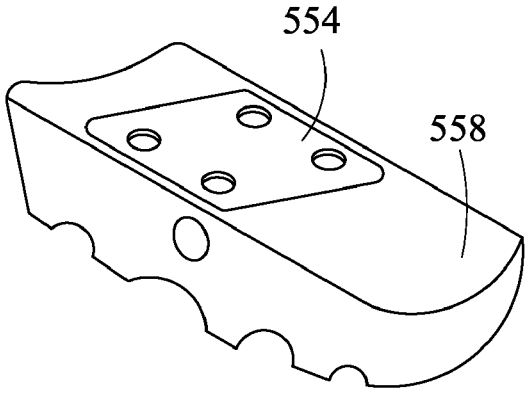
Figure 5D:
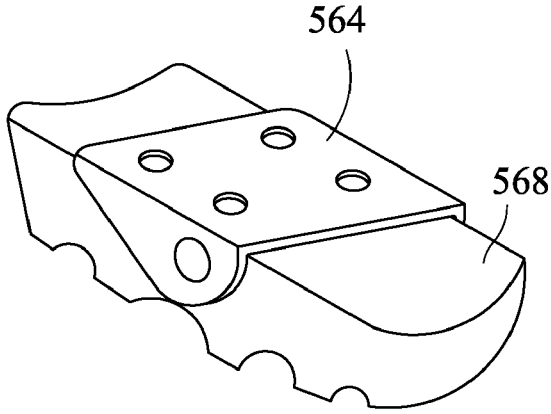

Reference is next made to FIGS. 5A-5D, which illustrates a boot system and modular coupling system, designated generally at 500. FIG. 5A illustrates a cross-section coronal view of a boot system 500, illustrating an alternative modular coupling system that sandwich couples the boot block to the shell. The system includes a shell 510, an internal shell plate 512, and a bracket member 534. A plurality of couplers 540 extend sagittally through recesses in the bracket member 534, the shell 510, and the internal shell plate 512, thereby sandwich coupling the bracket member 534 to the shell 510. The internal shell plate 512 distributes the coupling forces from the bracket member 534 across the lower portion of the shell 510 to avoid damaging the shell and maintaining optimum shell weight characteristics including but not limited to materials and wall thicknesses. As discussed above, the couplers may be any type of elongated couplers including but not limited to screws, bolts, pins, etc. Likewise, the recesses may be any type of coupling recesses including threaded, non-threaded, bosses, etc. The shell 510 further includes a binding interface surface 518. The binding interface surface 518 may be composed of various rigid materials including but not limited to plastic. The bracket member 534 further includes a rigid member, a transverse binding interconnect 536 and an exterior structure 538. The transverse binding interconnect 536 is part of the rigid member. The exterior structure 538 may form an increased friction sole surface such as a rubber tread region. FIG. 5B illustrates a bracket member 544 which may be utilized in conjunction with the modular coupling system illustrated in FIG. 5A. FIG. 5C illustrates a bracket member 554 and exterior structure 558, which may alternatively be utilized in conjunction with the modular coupling system illustrated in FIG. 5A. FIG. 5D illustrates a bracket member 564 and exterior structure 568, which may alternatively be utilized in conjunction with the modular coupling system illustrated in FIG. 5A.

Various other embodiments have been contemplated including combinations in whole or in part of the embodiments described above.

What is claimed is:

1. A ski boot system with a modular binding interface comprising:

a shell configured to encase a user's foot and a portion of a user's lower leg, wherein the shell includes a base, toe, and heel;

a first block releasably coupled to the shell substantially sagittally below the base, wherein the first block includes a first binding interface surface extending distally from the toe of the shell, and wherein the first block includes a first sole surface configured as the lowest sagittal surface of the ski boot system; and a second block configured to modularly couple to the shell substantially below the base in exchange for the first block, wherein the second block includes a second binding interface surface and a second sole surface, and wherein the distance between the second binding interface surface and the shell is sagittally different from than the distance between the first binding interface surface system and with respect to the shell, and wherein the distance between the second sole surface and the shell is substantially sagittally the same as the distance between the first sole surface and with respect to the shell.

2. The system of claim 1, wherein the first and second binding interface surfaces include at least one of lateral recesses, lateral pins, a front shelf, a duckbill, and a notch.

3. The system of claim 1, wherein the shell, first block, and second block include a plurality of recesses oriented sagittally, and wherein the releasable coupling between one of the first and second blocks and the shell includes sagittally extending a plurality of coupling members through the recesses in both the shell and one of the first and second block.

4. The system of claim 1, wherein the shell includes a plurality of sagittally extended members oriented sagittally toward the sole surface, and wherein the sagittally extended member include a transverse recess, and wherein the first and second block include a recess oriented transversely, and wherein the releasable coupling between one of the first and second block and the shell includes transversely extending at least one coupling member through the transverse recesses of the sagittally extended members and one of the first and second block.

5. The system of claim 1, wherein the shell includes a rigid geometrically keyed region, and wherein the first and second block include a corresponding rigid geometrically keyed region configured to interface with the geometrically keyed region, and wherein the releasable coupling between one of the first and second block and the shell includes geometrically engaging the geometrically keyed region of the shell with the corresponding geometrically keyed region of one of the first and second block.

6. The system of claim 5, wherein the releasable coupling between one of the first and second block and the shell further includes extending a plurality of coupling members sagittally through one of the first and second block and the shell.

7. The system of claim 1, wherein the first and second block includes a rigid member and a block structure, and wherein the shell includes a rigid bracket member disposed within the shell, and wherein the releasable coupling between one of the first and second block and the shell includes extending a plurality of coupling members through both the rigid member and block structure components of one of the first and second block and the rigid bracket member of the shell so as to sandwich couple one of the first and second block to the shell.

8. The system of claim 1, wherein the releasable coupling between one of the first and second block and the shell includes a multi-directional attachment system including at least one sagittally oriented coupling member and a geometrical key lock engagement.

9. A ski boot system with a modular binding interface comprising:

a shell configured to encase a user's foot and a portion of a user's lower leg, wherein the shell includes a base, toe, and heel;

a first block releasably coupled the shell substantially sagittally below the base, wherein the first block includes a first binding interface surface extending distally from the toe of the shell, and wherein the first block includes a first sole surface configured as the lowest sagittal surface of the ski boot system; and wherein the releasable coupling between one of the first block and the shell includes a modular coupling system configured enable the releasably coupling with alternative blocks to adjust the sagittal position of an alternative binding interface surface with respect to the shell while maintaining creating an alternative a substantially constant spacing between the sole surface that is substantially sagittally positioned and the shell. the same as the first sole surface.

10. The system of claim 9, wherein, wherein the first and alternative binding interface surfaces include at least one of lateral recesses, lateral pins, a front shelf, a duckbill, and a notch.

11. The system of claim 9, wherein the shell and first block include a plurality of recesses oriented sagittally, and wherein the modular coupling system between the first block and the shell includes sagittally extending a plurality of coupling members through the recesses in both the shell and the first block.

12. The system of claim 9, wherein the shell includes a plurality of sagittally extended members oriented sagittally toward the sole surface, and wherein the sagittally extended member include a transverse recess, and wherein the first block includes a recess oriented transversely, and wherein the modular coupling system between the first block and the shell includes transversely extending at least one coupling member through the transverse recesses of the sagittally extended members and one of the first and second block.

13. The system of claim 9, wherein the shell includes a rigid geometrically keyed region, and wherein the first and second block include a corresponding rigid geometrically keyed region configured to interface with the geometrically keyed region, and wherein the releasable coupling between one of the first and second block and the shell includes geometrically engaging the geometrically keyed region of the shell with the corresponding geometrically keyed region of one of the first and second block.

14. The system of claim 13, wherein the modular coupling system between the first block and the shell further includes extending a plurality of coupling members sagittally through the first block and the shell.

15. The system of claim 9, wherein the first block includes a rigid member and a block structure, and wherein the shell includes a rigid bracket member disposed within the shell, and wherein the modular coupling system between the first block and the shell includes extending a plurality of coupling members through both the rigid member and block structure components of the first block and the rigid bracket member of the shell so as to sandwich couple one of the first block to the shell.

16. The system of claim 9, wherein the modular coupling system between the first block and the shell includes a multi-directional attachment system including at least one sagittally oriented coupling member and a geometrical key lock engagement.

17. A method for modularly coupling alternative blocks to a shell on a ski boot so as to effectuate alternative binding interface surface sagittal positions without substantially effecting sagittal sole surface orientation, comprising the acts of:

providing a shell configured to encase a foot and a portion of a lower leg;

providing a plurality of blocks each including a binding interface surface and a sole surface, wherein the binding interface surface includes a surface distally extending from a toe region of the shell, and wherein the sole surface is the lowest sagittal surface of the ski boot;

coupling a first block to the shell, positioning the binding interface surface of the first block at a particular first binding interface surface sagittal height with respect to the shell;

positioning the sole surface of the first block at a particular first sole surface sagittal height with respect to the shell;

decoupling the first block from the shell;

coupling a second block the shell in substantially the same orientation and position as the first block with respect to the shell;

positioning the binding interface surface of the second block at a particular binding interface surface sagittal height with respect to the shell that is different from the first binding interface sagittal height; and positioning the sole surface of the second block at a particular sole surface sagittal height with respect to the shell that is substantially the same as the first sole surface sagittal height.

18. The method of claim 17, wherein the act of coupling a first block to the shell includes sagittally extending a plurality of coupling members through recesses in the first block and the shell.

19. The method of claim 17, wherein the act of coupling a first block to the shell includes transversely extending at least one coupling member through recesses in the first block and the shell.

20. The method of claim 17, wherein the act of coupling a first block to the shell includes geometrically engaging corresponding rigid regions on the first block and shell.

* * * * *